US008657577B2

(12) United States Patent
Martin et al.

(10) Patent No.: US 8,657,577 B2
(45) Date of Patent: Feb. 25, 2014

(54) GAS TURBINE WITH SECURING PLATE BETWEEN BLADE BASE AND DISK

(75) Inventors: Nicholas F. Martin, Winter Park, FL (US); Christoph Schiefer, Mülheim an der Ruhr (DE); Peter Schröder, Essen (DE); Bernd Van Den Toorn, Mülheim an der Ruhr (DE)

(73) Assignee: Siemens Aktiengesellschaft, München (DE)

( * ) Notice: Subject to any disclaimer, the term of this patent is extended or adjusted under 35 U.S.C. 154(b) by 396 days.

(21) Appl. No.: 13/127,604

(22) PCT Filed: Sep. 10, 2009

(86) PCT No.: PCT/EP2009/061757

§ 371 (c)(1),
(2), (4) Date: Jul. 21, 2011

(87) PCT Pub. No.: WO2010/052053

PCT Pub. Date: May 14, 2010

(65) Prior Publication Data

US 2011/0268564 A1 Nov. 3, 2011

(30) Foreign Application Priority Data

Nov. 5, 2008 (EP) ..... 08019366

(51) Int. Cl.
*F01D 5/00* (2006.01)

(52) U.S. Cl.
USPC ..... 416/96 R; 416/220 R

(58) Field of Classification Search
USPC ..... 416/93 R, 90 R, 96 R, 219 R, 220 R, 221, 416/248; 415/115, 116
See application file for complete search history.

(56) References Cited

U.S. PATENT DOCUMENTS

| | | | |
|---|---|---|---|
| 2,847,187 | A | 8/1958 | Murphy |
| 2,928,651 | A | 3/1960 | Turnbull |
| 3,353,788 | A | 11/1967 | Weeds |
| 4,029,436 | A | 6/1977 | Shoup, Jr. et al. |
| 4,279,572 | A | 7/1981 | Auriemma |
| 4,470,757 | A | 9/1984 | Vollinger |
| 4,626,169 | A | 12/1986 | Hsing |
| 5,431,543 | A | 7/1995 | Brown |

(Continued)

FOREIGN PATENT DOCUMENTS

| | | |
|---|---|---|
| DE | 1 802 931 U | 12/1959 |
| DE | 1 802 931 A1 | 5/1970 |

(Continued)

*Primary Examiner* — Edward Look
*Assistant Examiner* — Maxime Adjagbe

(57) ABSTRACT

A turbine rotor is provided. The turbine rotor has a plurality of blades assembled into blade rows and arranged on a turbine disk. Each blade has a blade root arranged in a blade retaining slot of the turbine disk extending in an axial direction. A locking plate is arranged between the respective blade root and a base of the blade retaining slot, for securing blades against a displacement along the blade retaining slot. The locking plate is fixed to the turbine disk by folds. The locking plate comprises a plurality of cooling air holes for the passage of cooling medium from a cooling air feed passage. The respective blade root comprises two grooves extending substantially azimuthally in relation to a turbine axis, and the respective locking plate comprises two tongues which are arranged such that they are connected to the two grooves of the blade root for sealing.

6 Claims, 4 Drawing Sheets

(56) References Cited

U.S. PATENT DOCUMENTS

| | | | |
|---|---|---|---|
| 5,622,476 | A | 4/1997 | Adde |
| 6,471,213 | B1 | 10/2002 | Toshishige |
| 2006/0207309 | A1 | 9/2006 | Miosga |
| 2007/0041836 | A1 | 2/2007 | Tschuor |
| 2008/0253895 | A1 | 10/2008 | Gekht et al. |

FOREIGN PATENT DOCUMENTS

| | | | |
|---|---|---|---|
| DE | 199 25 774 | A1 | 12/2000 |
| DE | 100 31 116 | A1 | 1/2002 |
| DE | 10031116 | A1 | 1/2002 |
| DE | 101 40 259 | C1 | 1/2003 |
| DE | 10140259 | C1 | 1/2003 |
| EP | 0 340 149 | A1 | 11/1989 |
| EP | 1 703 078 | A1 | 9/2006 |
| EP | 1703078 | A1 | 9/2006 |
| GB | 643 914 | A | 9/1950 |
| GB | 0643913 | | 9/1950 |
| JP | 49120205 | A | 11/1974 |
| JP | 59101599 | | 6/1984 |
| JP | 59113207 | | 6/1984 |
| JP | 63170504 | A | 7/1988 |
| JP | 11036806 | A | 2/1999 |
| RU | 2265754 | C2 | 12/2005 |
| SU | 1657670 | A1 | 6/1991 |

GAS TURBINE WITH SECURING PLATE BETWEEN BLADE BASE AND DISK

CROSS REFERENCE TO RELATED APPLICATIONS

This application is the US National Stage of International Application No. PCT/EP2009/061757 filed Sep. 10, 2009 and claims the benefit thereof. The International Application claims the benefits of European application No. 08019366.7 EP filed Nov. 5 2008. All of the applications are incorporated by reference herein in their entirety.

FIELD OF INVENTION

The invention refers to a turbine rotor for a gas turbine with a number of rotor blades which are assembled in each case to form rotor blade rows and arranged in each case on a turbine disk, having a blade root in each case which is arranged in each case in an axially extending rotor blade retaining slot of the turbine disk, wherein between the respective blade root and a base of the rotor blade retaining slot a locking plate is arranged for securing rotor blades against displacement along the rotor blade retaining slot, which locking plate is fixed on the turbine disk by means of folds.

BACKGROUND OF INVENTION

Gas turbines are used in many fields for driving generators or driven machines. In this case, the energy content of a fuel is used for producing a rotational movement of a turbine rotor. For this, the fuel is combusted in a combustion chamber, wherein compressed air is fed from an air compressor. The operating medium, under high pressure and under high temperature, which is produced in the combustion chamber as a result of combusting the fuel is directed in this case through a turbine unit, which is connected downstream to the combustion chamber, where it expands, performing work.

For producing the rotational movement of the turbine rotor, in this case a number of rotor blades, which customarily are assembled into blade groups or blade rows, are arranged on this turbine rotor. In this case, for each turbine stage provision is customarily made for a turbine disk on which the rotor blades are fastened by means of their blade root. For flow guiding of the operating medium in the turbine unit, moreover, stator blades, which are connected to the turbine casing and assembled to form stator blade rows, are customarily arranged between adjacent rotor blade rows.

The combustion chamber of the gas turbine can be constructed as a so-called annular combustion chamber, in which a multiplicity of burners, which are arranged around the turbine rotor in the circumferential direction, lead into a common combustion chamber space which is enclosed by a high temperature-resistant surrounding wall. For this, the combustion chamber in its entirety is designed as an annular structure. In addition to a single combustion chamber, provision may also be made for a multiplicity of combustion chambers.

A first stator blade row of a turbine unit as a rule directly adjoins the combustion chamber and together with the directly following rotor blade row, as seen in the flow direction of the operating medium, forms a first turbine stage of the turbine unit to which further turbine stages are customarily connected downstream.

In the design of such gas turbines, in addition to the achievable output, a particularly high efficiency is customarily a design aim. An increase in the efficiency in this case can be achieved, for thermodynamic reasons, basically by increasing the exit temperature at which the operating medium flows out of the combustion chamber and flows into the turbine unit. In this case, temperatures of about 1200° C. to 1500° C. are aimed at and also achieved for such gas turbines.

With such high temperatures of the operating medium, however, the components and parts which are exposed to this are subjected to high thermal loads. In order to protect the turbine disk and the turbine rotor against penetration of hot operating medium, provision is customarily made on the turbine disks for sealing plates which are attached in a circularly encompassing manner on the turbine disk on the surfaces which in each case are normal to the turbine axis. In this case, provision is customarily made on each side of the turbine disk in each case for a sealing plate per turbine blade. These overlap in a shingle-like manner and customarily have a sealing wing which extends as far as the adjacent stator blade in each case in such a way that penetration of hot operating medium in the direction of the turbine rotor is avoided.

The sealing plates, however, fulfill further functions. On the one hand, they form the axial fixing of the turbine blades by means of corresponding fastening elements, and on the other hand, they seal not only the turbine disk against penetration of hot gas from outside but also avoid escape of cooling air which is guided inside the turbine disk and is customarily further directed for cooling of the turbine blades themselves.

The aforesaid design of the turbine disks with sealing plates which overlap in a segmented, shingle-like manner, however, is relatively complicated. A relatively large number of sealing plates are required, which leads to a comparatively high construction cost of the turbine disks and therefore of the entire gas turbine. Furthermore, a possible necessary repair in the region of the turbine disks can be comparatively costly as a result of this construction.

A turbine rotor which is referred to in the introduction is known from EP 1 703 078 A1, DE 199 25 774 A1, GB 643,914 and DE 100 31 116 A1 in each case. In addition, it is known from U.S. Pat. No. 4,470,757 to adjust the amount of cooling air which flows into the rotor blade by means of plates which are provided solely for this.

SUMMARY OF INVENTION

The invention is therefore based on the object of disclosing a turbine rotor for a gas turbine, which rotor, installed in a gas turbine, allows a simplified construction while retaining the highest possible operational reliability and highest possible gas turbine efficiency.

This object is achieved according to the invention by a cooling air feed passage leading to the base of the rotor blade retaining slots for feed of cooling medium, by the respective locking plate having a number of cooling air holes for passage of cooling medium and by the respective blade root comprising two grooves which extend essentially azimuthally with regard to the turbine axis and by the respective locking plate comprising two tongues which are arranged in such a way that for sealing they can be connected to the grooves of the blade root in a form-fitting manner.

The invention starts in this case from the consideration that a simplified construction of the gas turbine, especially in the region of the turbine disks, would be possible if the previously customary construction with sealing plates arranged in a shingle-like manner could be simplified. A particularly simple development would especially be possible when the sealing plates could be completely dispensed with. The absence of a fixing of the turbine blades in the axial direction which results from this, however, is a problem. With the sealing plates being dispensed with, an axial fixing of the turbine blades would therefore have to be carried out in another way. For this, a locking plate, which enables a particularly simple fixing of the blade root on the turbine disk and can be flexibly adapted to the respective geometric requirements of the fixing, is arranged between the respective blade root and the turbine rotor.

For fixing on the turbine disk, the respective locking plate in this case comprises a number of folds. These encompass the turbine disk in the axial direction and so enable a secure fixing. Fixing by means of folds, moreover, is particularly production-friendly by the not yet folded-over flat locking plate being first fixed on the blade root of the turbine blade, the blade root being inserted with the locking plate, and the locking plate then being folded over for the axial fixing. As a result, in addition to the secure fixing, a particularly simple installation is possible.

In order to also guarantee a secure axial connection of the blade root to the locking plate, the respective blade root first comprises a number of grooves which extend essentially azimuthally with regard to the turbine rotor, and also the respective locking plate furthermore comprises a number of tongues which are arranged in such a way that they can be connected to the grooves of the blade root in a form-fitting manner. The grooves therefore serve as a socket for corresponding tongues on the locking plate. In this way, a secure axial connection of the locking plate to the blade root is achieved as a result of a form-fitting tongue-in-groove connection.

Moreover, the respective locking plate comprises a number of cooling air holes. As a result, cooling air can be directed through the interior of the turbine disk and through the corresponding cooling air holes in the locking plate into the blade root and consequently into the turbine blade and as a result a reliable cooling of the turbine blade is enabled.

On account of the rotor blade which is to be cooled, this can be supplied with cooling air via a cooling-air feed passage which leads to the base of the retaining slot. In order to ensure in this case a transfer of cooling air from the cooling-air feed passage into the rotor blade with as little loss as possible, the tongue-in-groove connection of blade root and locking plate on the one hand, and the seating of the locking plate between blade root underside and slot base on the other hand, is also designed as a seal.

The previously customary sealing plates, however, serve not only for axial fixing of the rotor blades, but seal the blade root even against hot gas which could penetrate from the inner space in the direction of the turbine rotor and could cause damage there. Despite dispensing with the sealing plates, in order to achieve adequate sealing of the turbine disks and of the turbine rotor against penetration of hot operating medium, corresponding sealing should be achieved by means of other components. In order to achieve the desired simplification of construction in this case, no new components should be added in the process, but the sealing function should be achieved by already available components by corresponding modifications. For this, sealing wings, which extend in each case to the adjacent stator blade rows, should advantageously be fastened on the blade roots of the rotor blades.

The respective sealing wing advantageously extends essentially in the axial and azimuthal directions with regard to the turbine rotor. Consequently, sealing in a plane which is perpendicular to the potential penetration direction of the hot operating medium is carried out. As a result, complete sealing of the region which lies beneath the blade root in the direction of the turbine rotor against hot gas which flows inside the gas turbine is achieved.

In a further advantageous development, the respective blade root has a sealing wing in each case in both axial directions. As a result, it is possible to achieve sealing against penetrating hot gas on both sides of the turbine blade.

Such a gas turbine is advantageously used in a gas- and steam turbine plant.

The advantages which are associated with the invention are especially that by introducing locking plates between blade root and turbine disk of a gas turbine, the previously customary sealing plates can be dispensed with so that a substantially simplified and more favorable construction of the gas turbine is possible. The design of the entire rotor blade row is consequently substantially simplified, also the weight can be reduced so that less mechanical loads occur and the turbine disk can be constructed correspondingly smaller and more favorably. Furthermore, the previously required complex slots for fixing the sealing plate in the turbine disk can be dispensed with. As a result of fixing the blade root on the turbine disk by means of a tongue-in-groove connection, a particularly secure axial fixing is ensured even without sealing plates so that wear during operation can be kept comparatively low.

BRIEF DESCRIPTION OF THE DRAWINGS

An exemplary embodiment of the invention is explained in more detail with reference to a drawing. In the drawing.

DETAILED DESCRIPTION OF INVENTION

Like parts are provided with the same designations in all the figures.

Figure 1:
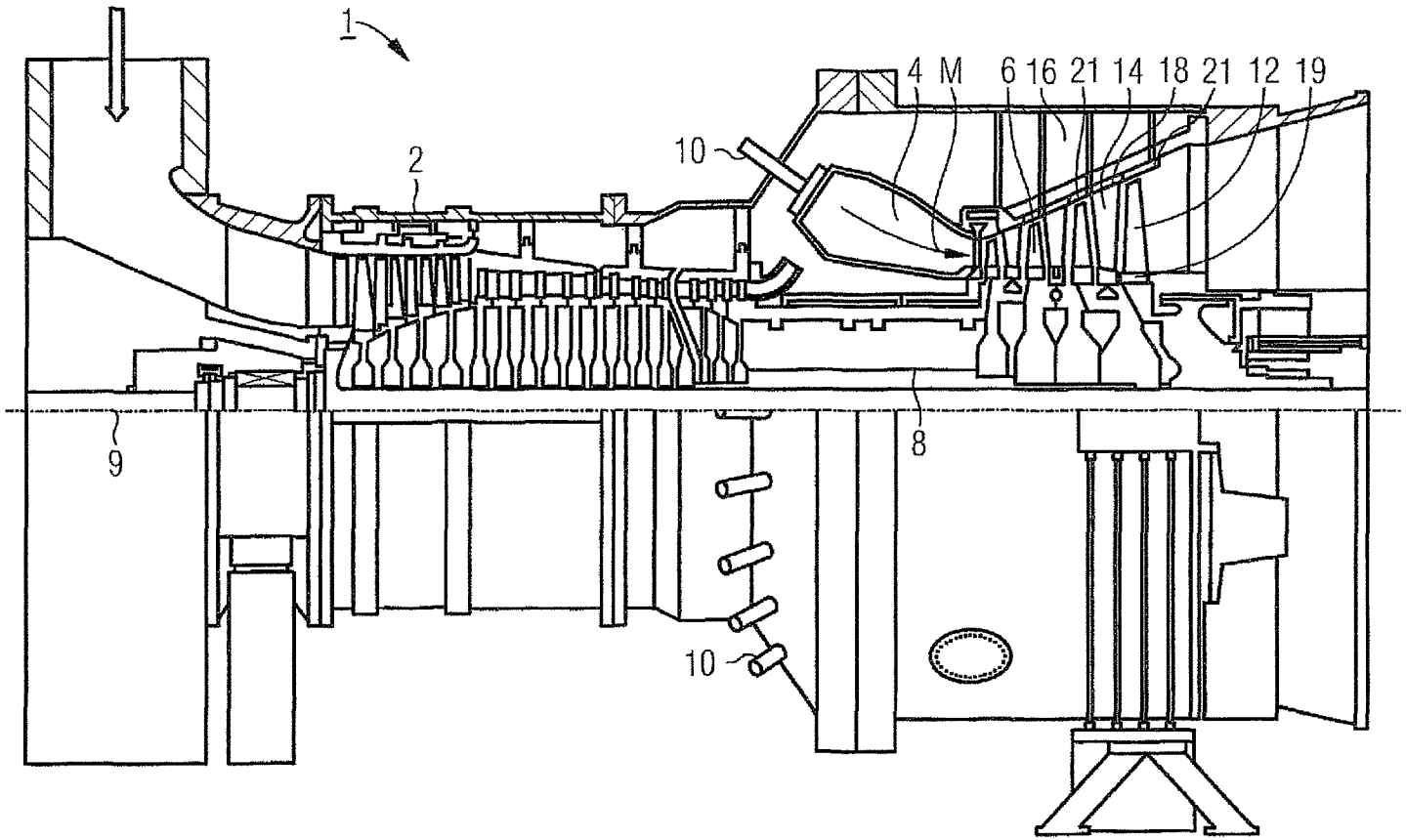
FIG. 1 shows a half-section through a gas turbine.

The gas turbine 1 according to FIG. 1 has a compressor 2 for combustion air, a combustion chamber 4 and also a turbine unit 6 for driving the compressor 2 and driving a generator or a driven machine, which is not shown. In addition, the turbine unit 6 and the compressor 2 are arranged on a common turbine rotor 8 which is also referred to as a turbine rotating component to which the generator or the driven machine is also connected, and which is rotatably mounted around its center axis 9. The combustion chamber 4 which is constructed in the style of an annular combustion chamber is equipped with a number of burners 10 for combusting a liquid or gaseous fuel.

The turbine unit 6 has a number of rotatable rotor blades 12 which are connected to the turbine rotor 8. The rotor blades 12 are arranged on the turbine rotor 8 in a ring-like manner and therefore form a number of rotor blade rows. Furthermore, the turbine unit 6 comprises a number of fixed stator blades 14 which are also fastened in a ring-like manner on a stator blade carrier 16 of the turbine unit 6, forming stator blade rows. The rotor blades 12 in this case serve for driving the turbine rotor 8 as a result of impulse transfer from the operating medium M which flows through the turbine unit 6. The stator blades 14 on the other hand serve for flow guiding of the operating medium M between two consecutive rotor blade rows or rotor blade rings in each case, as seen in the flow direction of the operating medium M. A consecutive pair, consisting of a ring of stator blades 14 or a stator blade row and a ring of rotor blades 12 or a rotor blade row, in this case is also referred to as a turbine stage.

Each stator blade 14 has a platform 18 which, for fixing of the respective stator blade 14 on a stator blade carrier 16 of the turbine unit 6, is arranged as a wall element. The platform 18 in this case is a thermally comparatively heavily loaded component which forms the outer limit of a hot gas passage for the operating medium M which flows through the turbine unit 6. Each rotor blade 12 is fastened in a similar way on the turbine rotor 8 via a platform 19.

Between the platforms 18—which are arranged in a spaced apart manner—of the stator blades 14 of two adjacent stator blade rows, a guide ring 21 is arranged in each case on a stator blade carrier 16 of the turbine unit 6. The outer surface of each guide ring 21 in this case is also exposed to the hot operating medium M which flows through the turbine unit 6 and in the radial direction, as a result of a gap, is at a distance from the outer end of the rotor blades 12 which lie opposite it.

The guide rings 21 which are arranged between adjacent stator blade rows in this case especially serve as cover elements which protect the inner casing 16 in the stator blade carrier or other installed components of the casing against thermal overstress as a result of the hot operating medium M which flows through the turbine 6.

The combustion chamber 4 in the exemplary embodiment is designed as a so-called annular combustion chamber in which a multiplicity of burners 10, which are arranged around the turbine rotor 8 in the circumferential direction, lead into a common combustion chamber space. For this, the combustion chamber 4 in its entirety is designed as an annular structure which is positioned around the turbine rotor 8.

Figure 2:
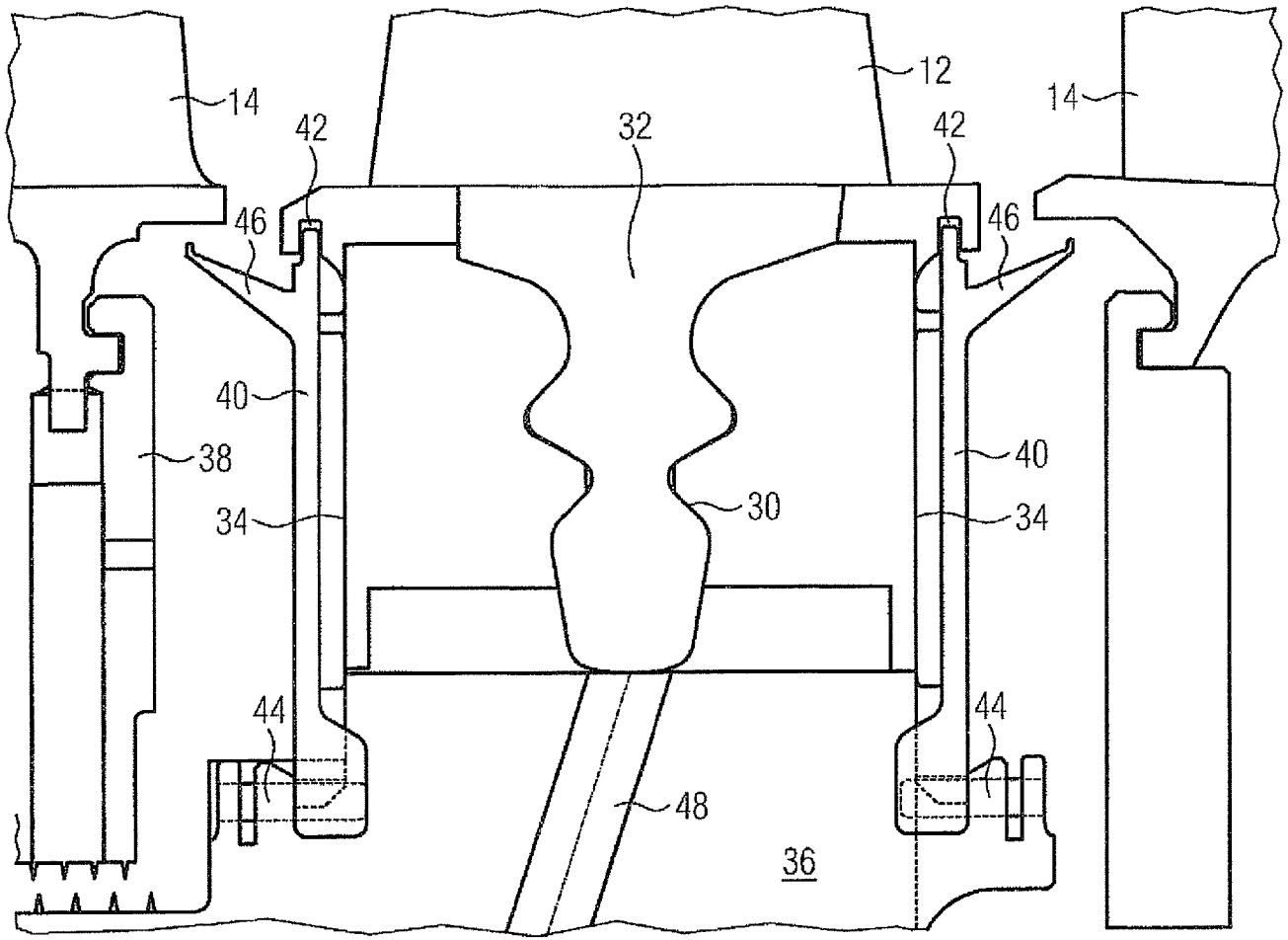
FIG 2 (Prior Art)
FIG. 2 shows a half-section through the outer periphery of a turbine disk for the gas turbine with sealing plates.

FIG. 2 shows in detail a section through the outer periphery of a turbine disk—which is attached on the turbine rotor 8—of a rotor blade stage of the turbine unit 6 according to the prior art.

A rotor blade 12 is arranged in this case by its blade root 32 in a rotor blade retaining slot 30. The blade root 32 of the rotor blade 12 is of firtree shape in cross section and corresponds to the firtree shape of the rotor blade retaining slot 30. The schematic view of the contour of the rotor blade root 32 and that of the rotor blade retaining slot 30 is reproduced in a manner in which it is rotated by 90° in relation to the rest of the view of FIG. 2. Therefore, the depicted rotor blade retaining slot 30 extends between the side faces 34 of the turbine disk 36.

Furthermore, tip-side ends of stator blades 14 are schematically shown and—as seen in the flow direction of the operating medium of the gas turbine—are arranged upstream and downstream of the rotor blade 12. The stator blades 14 in this case are arranged radially in rings. The stator blades 14 of each ring are stabilized in this case by means of a fastening ring 38 provided on the tip side.

On both sides of the turbine disk 36, sealing plates 40 are inserted in each case on the sidewalls 34 in an encompassing shingle-like manner. These sealing plates are retained on their upper side in a slot 42 which is introduced into the rotor blade 12 and on their lower side are fixed by means of a locking bolt 44.

The sealing plates 40 in this case fulfill a multiplicity of tasks: One the one hand, by means of attached sealing wings 46 which extend essentially in the axial and azimuthal directions, they seal the gap between turbine disk 36 and adjacent stator blades 14 against penetration of hot operating medium M from the turbine. On the other hand, the sealing plates 40 also ensure axial fixing of the blade root 32 in the blade root slot 30 and so secure these against axial displacement. The radial and azimuthal securing is already achieved by means of the firtree shape of the rotor blade retaining slot 30. Furthermore, the sealing plates 40 prevent escape of cooling air which is introduced by means of cooling air passages 48 through the turbine disk 36 into the blade root 32 and the rotor blade 12.

Figure 3:
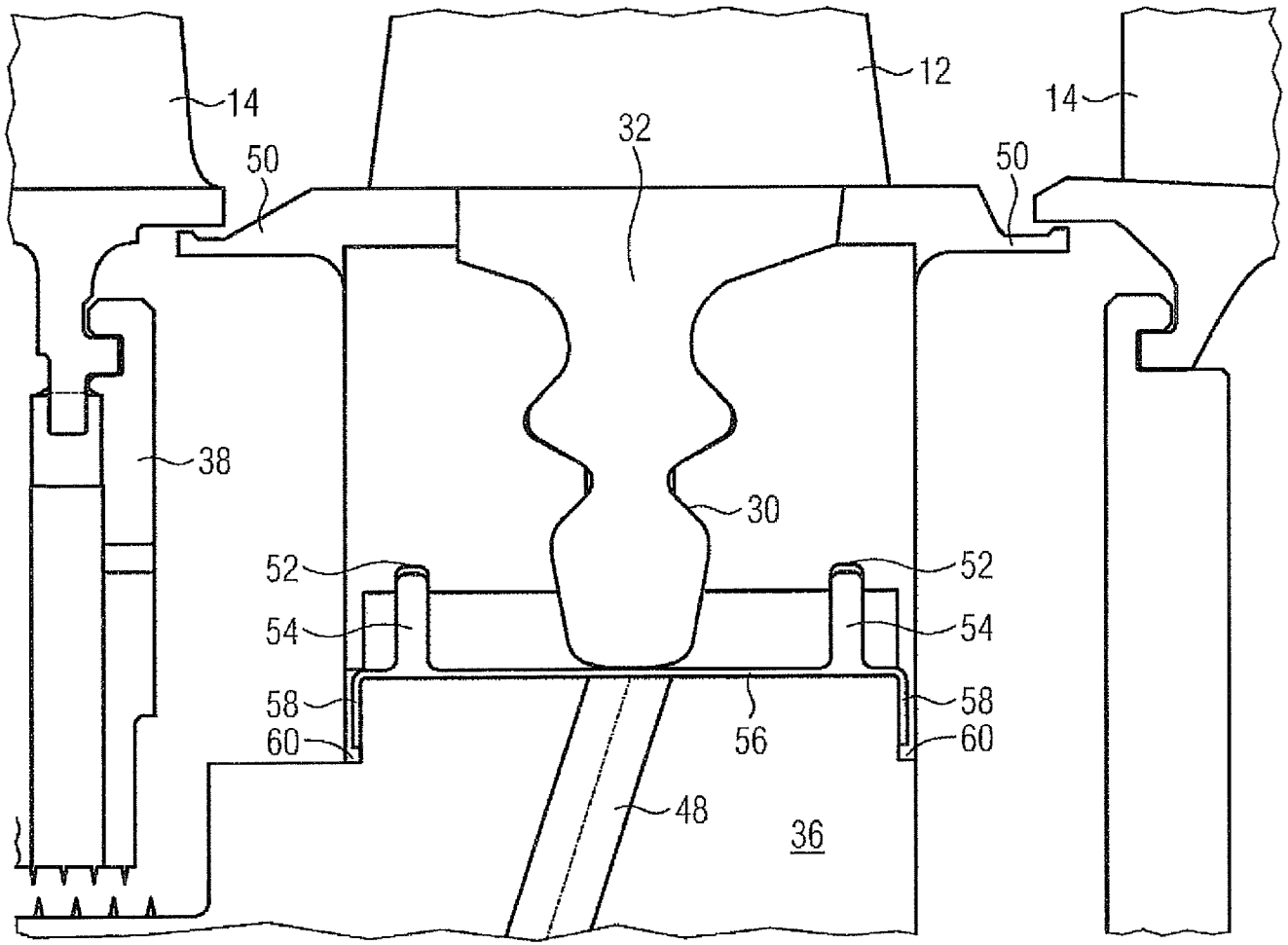
FIG. 3 shows a half-section through the outer periphery of a turbine disk for the gas turbine without sealing plates.

In order to enable a simpler, easier and more cost-effective construction of the gas turbine 1, the design should be modified so that the sealing plates 40 can be dispensed with. Such a construction is shown in FIG. 3 in a way corresponding to FIG. 2.

Also in this case, the rotor blade 12 and the adjacent stator blades 14 with the corresponding add-on parts are to be seen. In order to enable the sealing plates 40 to be dispensed with, sealing wings 50 are attached directly on the blade root 32 on one side. These prevent penetration of hot operating medium from the interior of the gas turbine 1 into the regions in the proximity of the turbine rotor. Furthermore, in order to ensure axial fixing of the blade root 32 of the rotor blade 12 in the rotor blade slot 30, grooves 52 which extend essentially azimuthally with regard to the turbine rotor are introduced into the blade root. These grooves engage with tongues 54 of the locking plate 56.

The locking plate 56 is provided with folds 58 which engage in corresponding recesses 60 of the turbine disk 36. As a result, axial fixing of the locking plate 56 on the turbine disk 36 and fixing of the blade root 30 on the locking plate 56 are ensured.

Such a construction is also especially production-friendly: For this, the locking plate 56 is not yet folded over before installation, that is to say has no folds 58. During installation, the tongues 54 of the locking plate 56 are first inserted into the grooves 52. Then, the blade root 32 is slid into the rotor blade retaining slot 30 and the locking plate folded over and therefore fixed.

Figure 4:
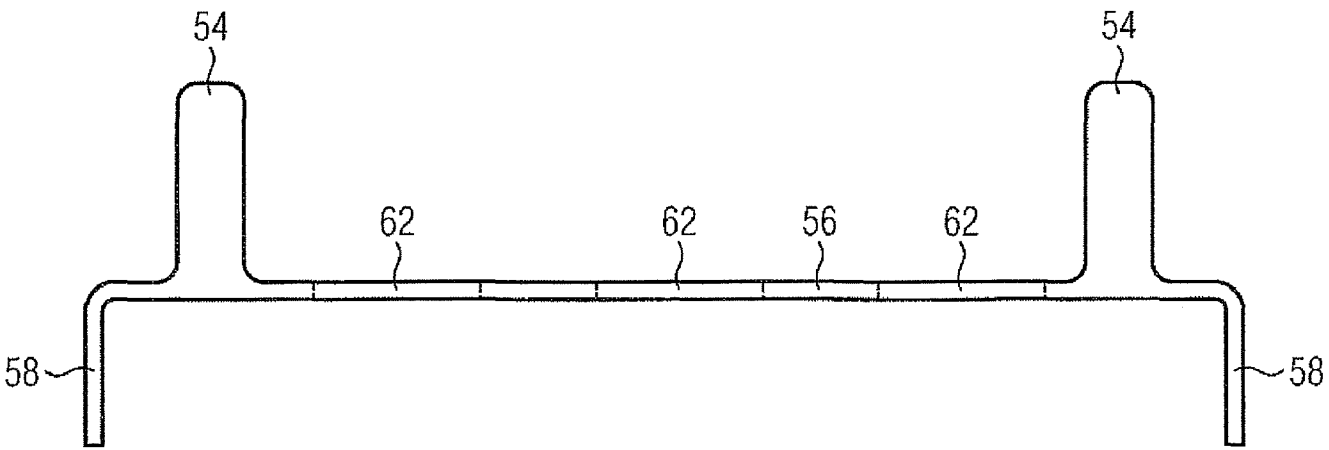
FIG. 4 shows an enlarged view of a locking plate.

The locking plate 56 is shown once more in enlarged view in FIG. 4. Clearly discernible are the tongues 54 for fixing of the blade root 32 of the rotor blade 12 and also the folds 58 for fixing on the turbine disk 36. The locking plate 56, moreover, has a number of cooling air holes 62 so that a passage of cooling air from the interior of the turbine disk 36 into the blade root 32 and into the rotor blade 12 is ensured.

As a result of the construction which is shown above, it is possible to allow the previously required sealing plates 40 to be completely dispensed with. All tasks undertaken up to now by the sealing plates 40 are undertaken by other, correspondingly adapted components. As a result, the sealing plates 40, which are relatively expensive to produce, can be dispensed with and an altogether lighter and more favorable construction of the gas turbine 1 is possible.

The invention claimed is:

1. A turbine rotor for a gas turbine, comprising:

a turbine disk comprising an axially extending rotor blade retaining slot;

a plurality of coolable rotor blades which are assembled in each case to form rotor blade rows, each of the plurality of coolable rotor blades being arranged on the turbine disk and comprising:

a respective blade root arranged in the axially extending rotor blade retaining slot of the turbine disk, the respective blade root comprising two grooves which extend substantially azimuthally with regard to a turbine axis, and a locking plate arranged between the respective blade root and a base of the rotor blade retaining slot, for securing rotor blades against displacement along the rotor blade retaining slot, the locking plate being fixed on the turbine disk by folds and comprising:

a plurality of cooling air holes, and two tongues which are arranged for sealing in such a manner that the two tongues are connected to the two grooves of the respective blade root in a form-fitting manner; and a cooling air feed passage leading to the base of the rotor blade retaining slot for feed of a cooling medium, wherein the cooling air holes of the locking plate provide a passage for the cooling medium.

2. The turbine rotor as claimed in claim 1, wherein the respective blade root has a sealing wing.

3. The turbine rotor as claimed in claim 2, wherein the sealing wing extends substantially in an axial and an azimuthal direction with regard to the turbine axis.

4. The turbine rotor as claimed in claim 2, wherein the respective blade root has two sealing wings in axial direction on both sides of respective blade root.

5. The turbine rotor as claimed in claim 3, wherein the respective blade root has two sealing wings in axial direction on both sides of respective blade root.

6. A gas- and steam turbine plant; comprising a turbine rotor, comprising:

a turbine disk comprising an axially extending rotor blade retaining slot;

a plurality of coolable rotor blades which are assembled in each case to form rotor blade rows, each of the plurality of coolable rotor blades being arranged on the turbine disk and comprising:

a respective blade root arranged in the axially extending rotor blade retaining slot of the turbine disk, the respective blade root comprising two grooves which extend substantially azimuthally with regard to a turbine axis, and a locking plate arranged between the respective blade root and a base of the rotor blade retaining slot, the locking plate being arranged for securing rotor blades against displacement along the rotor blade retaining slot, the locking plate being fixed on the turbine disk by folds and comprising:

a plurality of cooling air holes, and two tongues which are arranged for sealing in such a manner that the two tongues are connected to the two grooves of the respective blade root in a form-fitting manner; and a cooling air feed passage leading to the base of the rotor blade retaining slot for feed of a cooling medium, wherein the cooling air holes of the locking plate provide a passage for the cooling medium.

* * * * *